US006017050A

United States Patent [19]

Girard

[11] Patent Number: 6,017,050

[45] Date of Patent: Jan. 25, 2000

[54] ASSEMBLY FOR BINDING A BOOT TO A GLIDING ELEMENT

[75] Inventor: Francois Girard, Veyrier Du Lac, France

[73] Assignee: Salomon S.A., Metz-Tessy, France

[21] Appl. No.: 08/729,520

[22] Filed: Oct. 11, 1996

[30] Foreign Application Priority Data

Oct. 16, 1995 [FR] France ..... 95.12418

[51] Int. Cl.[7] ..... A63C 9/18

[52] U.S. Cl. ..... 280/615; 280/613

[58] Field of Search ..... 280/613, 614, 280/615, 634, 631, 632; 36/117.2

[56] References Cited

U.S. PATENT DOCUMENTS

| | | | |
|---|---|---|---|
| 2,172,669 | 9/1939 | Taft | 280/614 |
| 4,273,355 | 6/1981 | Storandt | 280/614 |
| 4,836,572 | 6/1989 | Pozzobon | 280/614 |
| 4,907,817 | 3/1990 | Schwarz | 280/615 |
| 4,909,531 | 3/1990 | Graillat | 280/615 |
| 5,066,036 | 11/1991 | Broughton | 280/615 |
| 5,125,680 | 6/1992 | Bejean et al. | 280/615 |
| 5,224,730 | 7/1993 | Provence et al. | 280/615 |
| 5,282,642 | 2/1994 | Provence | 280/615 |

FOREIGN PATENT DOCUMENTS

| | | | |
|---|---|---|---|
| 0039489 | 11/1981 | European Pat. Off. . | |
| 2642980 | 8/1990 | France . | |
| 3935202 | 5/1990 | Germany | 280/615 |
| 94/09660 | 5/1994 | WIPO | 280/615 |

*Primary Examiner*—J. J. Swann
*Assistant Examiner*—Frank Vanaman
*Attorney, Agent, or Firm*—Greenblum & Berstein P.L.C.

[57] ABSTRACT

A boot/binding device apparatus assembly for a boot on a gliding member is of the type including an arrangement for binding the front end of the boot, the rear end of the boot being free to be raised with respect to the gliding member. The assembly includes an arrangement for control and continues elastic return of the boot towards the gliding member, located at the rear of the binding device of the front end of the boot. Advantageously, the control and elastic return arrangement is constituted by an anchoring device for the binding device cooperating with anchoring apparatus associated with the boot, at least one of the anchoring device of the boot or of the binding device being provided with an elastic return mechanism.

19 Claims, 6 Drawing Sheets

2
3
4
13
12
11a
16
5
16a
11b
18
17
19
20
11

ASSEMBLY FOR BINDING A BOOT TO A GLIDING ELEMENT

BACKGROUND OF THE INVENTION

1. Field of the Invention

The present invention relates to an assembly for binding a boot to a gliding member, such as a cross country ski, but which can also be constituted by a gliding member such as a snowboard, roller skates, ice skates, etc.

The invention is related more specifically to a binding assembly in which the boot is attached to the gliding member through its front portion, whereby its rear portion, especially the heel zone, remains free so as to allow for a movement of the foot.

2. Background and Material Information

A binding assembly of the above-mentioned type is especially used in cross country skiing where the movement of the foot is essential, both in the so-called conventional techniques and in the skating step.

The problem is to establish a compromise between two totally conflicting requirements, namely:

a maximum movement of the foot, which is necessary for obtaining a large stride amplitude; and an optimum control and guidance of the ski that, on the contrary, can only be obtained through a continuous "contact" of the foot with such ski.

This compromise has been obtained, until now, by providing a guiding edge which cooperates with the boot, over the entire length of the latter, and by means of an elastic system provided on the binding at the front of the boot and exerting thereon a return force towards the ski.

Such a system enables an important improvement to the guiding of the ski by the boot since the latter remains engaged, almost constantly, with the guiding edge of the ski itself during the lifting of the heel, as long as the metatarsal zone of the boot remains in support on the ski.

On the contrary, once the entire boot is separated from the upper surface of the ski and therefore escapes from the guiding edge, i.e., when in the position of extreme movement of the boot, the latter almost no longer permits any control of the ski. In addition to this problem, a problem of twisting of the boot sole rises as soon as the foot is raised, a twisting that is also detrimental to a good control of the ski.

SUMMARY OF THE INVENTION

The object of the present invention is to remedy these drawbacks and to provide an improved boot/binding assembly on a gliding member, which makes it possible to reconcile two conflicting requirements of maximum movement of the foot and control/guidance of the ski.

This goal is achieved with the boot/binding assembly according to the invention which is of the type comprising means for binding the front end of the boot, the rear end of the boot being free to be raised with respect to the gliding member, because it comprises means of control and permanent elastic return of the boot towards the gliding member, which means are located at the rear of the means for binding the front end of the boot.

In effect, the fact that the elastic return means of the boot are no longer arranged at the front of the boot as usual, but at the rear of the binding means of the front end of the boot, makes it possible to control the boot with respect to the gliding member over the entire zone of the latter, which extends between the binding means of its front end and these elastic return means, even when the boot is in the air and in the position of extreme movement of the boot, which results in an improved control and guidance. Furthermore, the torsional rigidity of the sole, even in the air, is improved since the sole can longer twist, i.e., it can no longer twist over itself, in a zone comprised between the two attachment and control means in succession. Finally, such a construction offers the advantage of not disturbing the flexional deformation of the sole.

Of course, the further these control and elastic return means at the rear, the more substantial the control of the boot will be; however, these control and elastic return means will preferably be located substantially at the level the metatarsophalangeal journal of the boot, this position constituting the compromise between a good control and a minimum space requirement for the binding device.

BRIEF DESCRIPTION OF DRAWINGS

The invention will be better understood and other characteristics thereof will become apparent from the description that follows, with reference to the annexed schematic drawing illustrating two preferred embodiments by way of non-limiting examples, and in which:

FIG. 7 is a detailed view, on a larger scale, of FIG. 6.

DETAILED DESCRIPTION OF THE PREFERRED EMBODIMENTS

Figure 1:
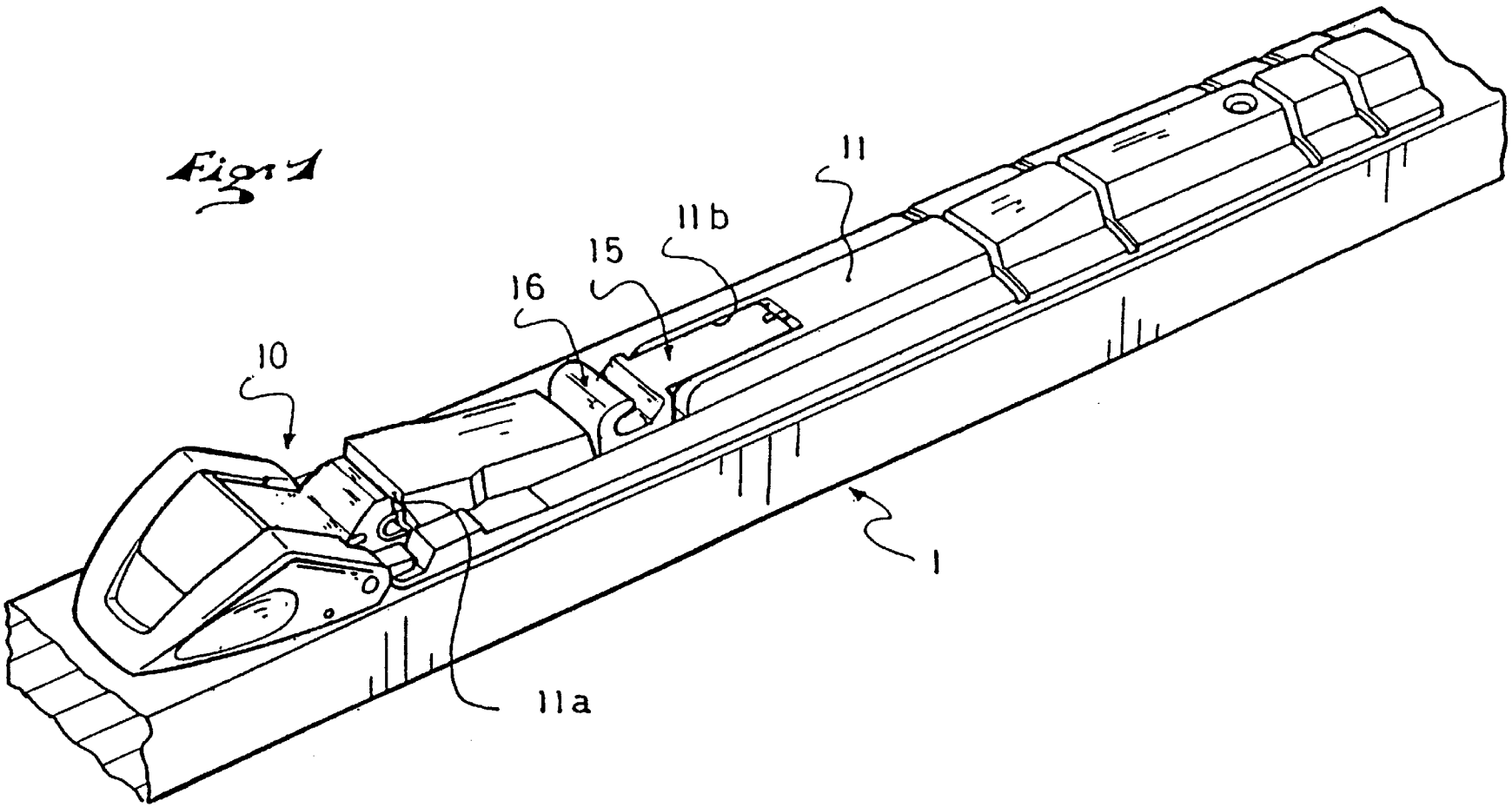
FIG. 1 is a perspective view of a binding apparatus according to the invention.

FIGS. 1–5 show the assembly of the boot 2 and the binding apparatus 10 according to the invention, which is applied to the linkage of the boot to a gliding member such as a cross country ski 1.

The cross country ski, in this case, is provided with the conventional aspect of a boot provided, on the lower surface of its sole, with a continuous longitudinal groove 3 adapted to cooperate with a continuous guiding rib or edge 11 of the binding device 10.

Furthermore, this boot 2 has, at its front end, a transverse axis in the form of a pin or attachment member 4 arranged across the groove 3 and, set-back from the axis 4, another transverse axis in the form of a pin or attachment member 5, which is also arranged across the groove 3 and is located substantially at the level of the metatarsophalangeal journal zone of the foot, and at the most at the rear limit of the first third of the length of the boot which constitutes the rear limit of the metatarsophalangeal journal zone.

Of course, any position of the transverse axis 5 is possible between the front axis 4 and the rear limit defined hereinabove.

The front transverse axis 4 is adapted to cooperate, in a known manner, with a forwardmost attachment 12, shown as a hook-shaped movable jaw, controlled by a lever 13, and the front edge 11*a* of the guiding rib constituting a fixed jaw, for the rotatable latching of the boot on the gliding member. Such a binding device is described, for example, in the previous patent FR 2 634 132 which is commonly owned, and can have a manual closure or a self-latching closure. Therefore, it will not be further described.

The binding device 10 further comprises a rearward attachment, shown in FIGS. 1–5 to include a connecting rod or member 15 which is housed within an associated recess and has an adjusted width 11*b* for the guiding edge (see FIG. 1), and has at its free front end a hooked-shaped element or anchoring part 16 turned rearwardly and adapted to cooperate with the rear transverse axis 5 of the boot for anchoring the latter at this level. As shown particularly in FIG. 1, the end of the hook 16 of the connecting rod has an enlarged form with respect to the remainder of the body of the connecting rod 15, or order to better adjust to the width of the groove 3 associated with the boot in this area, and to contribute to the guidance of the boot in the raised position thereof.

Figure 2:
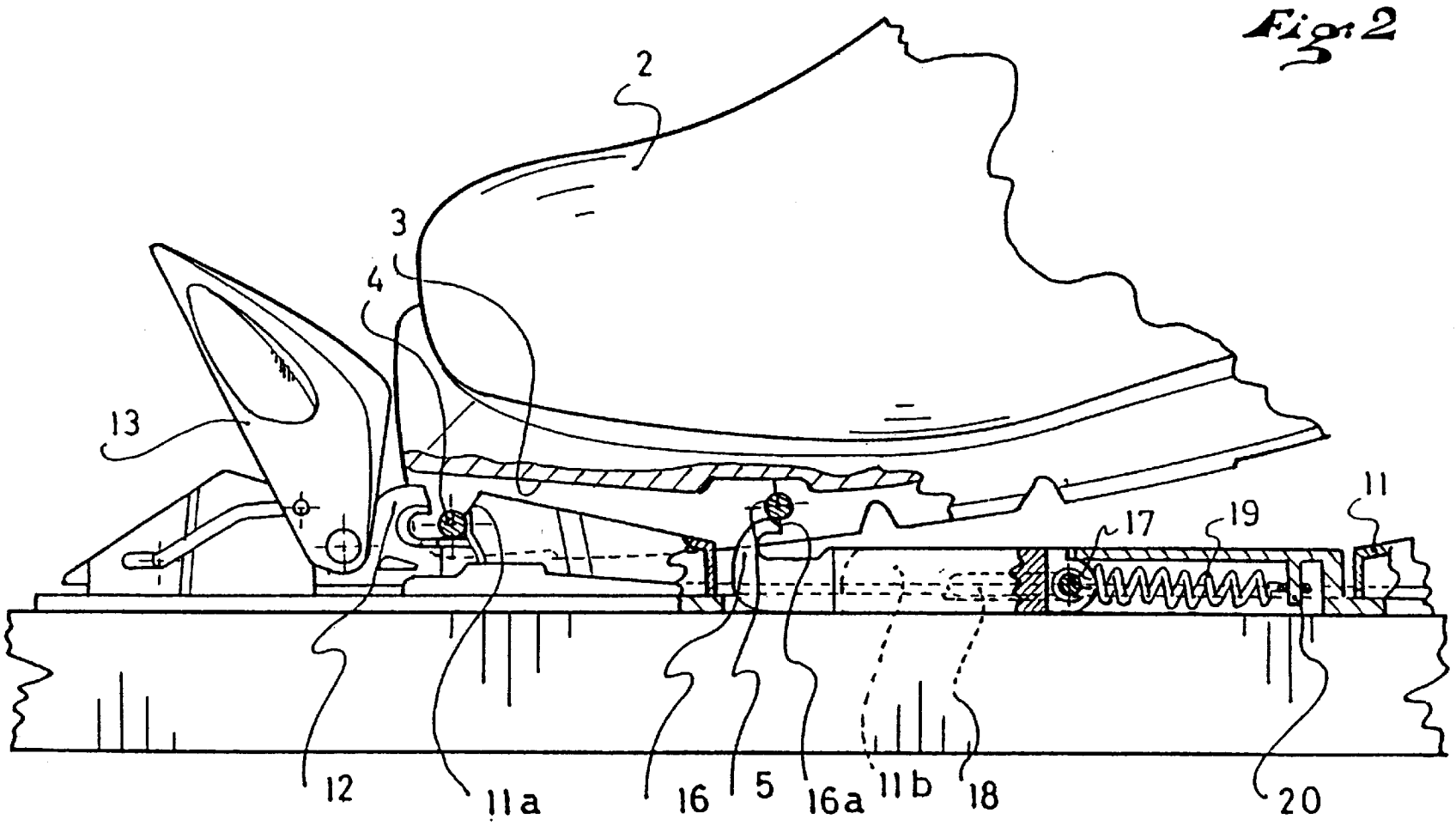
FIG. 2 is a partial longitudinal cross-sectional view of the binding apparatus of FIG. 1 and of an associated boot during fitting of the binding apparatus.

As shown more particularly in FIG. 2, the hook 16 has on its upper surface a ramp 16*a* adapted to facilitate the introduction therein of the transverse axis 5 of the boot.

The rearward attachment of the binding apparatus further includes the following. At its other end, the connecting rod 15 is journalled on the guiding edge 11 along a transverse axis in the form of a pin or axle 17. The transverse journal axis 17 is further slidably mounted in the longitudinal direction with respect to the guiding edge 11, in oblong guiding slots 18 provided within this edge.

Finally, a traction spring 19 is fixed on the axis 17, on the one hand, and on a shoulder 20 of the guiding edge and elastically opposes any forward sliding movement of the connecting rod 15, on the other hand.

Of course, the front and rear directions extend towards the front and rear of the ski, respectively, i.e. towards the left and right in the drawing, the longitudinal direction corresponding to the longitudinal direction of the sliding member or of the boot, and the transverse direction corresponding to a transverse direction of the sliding member/boot.

Figure 3:
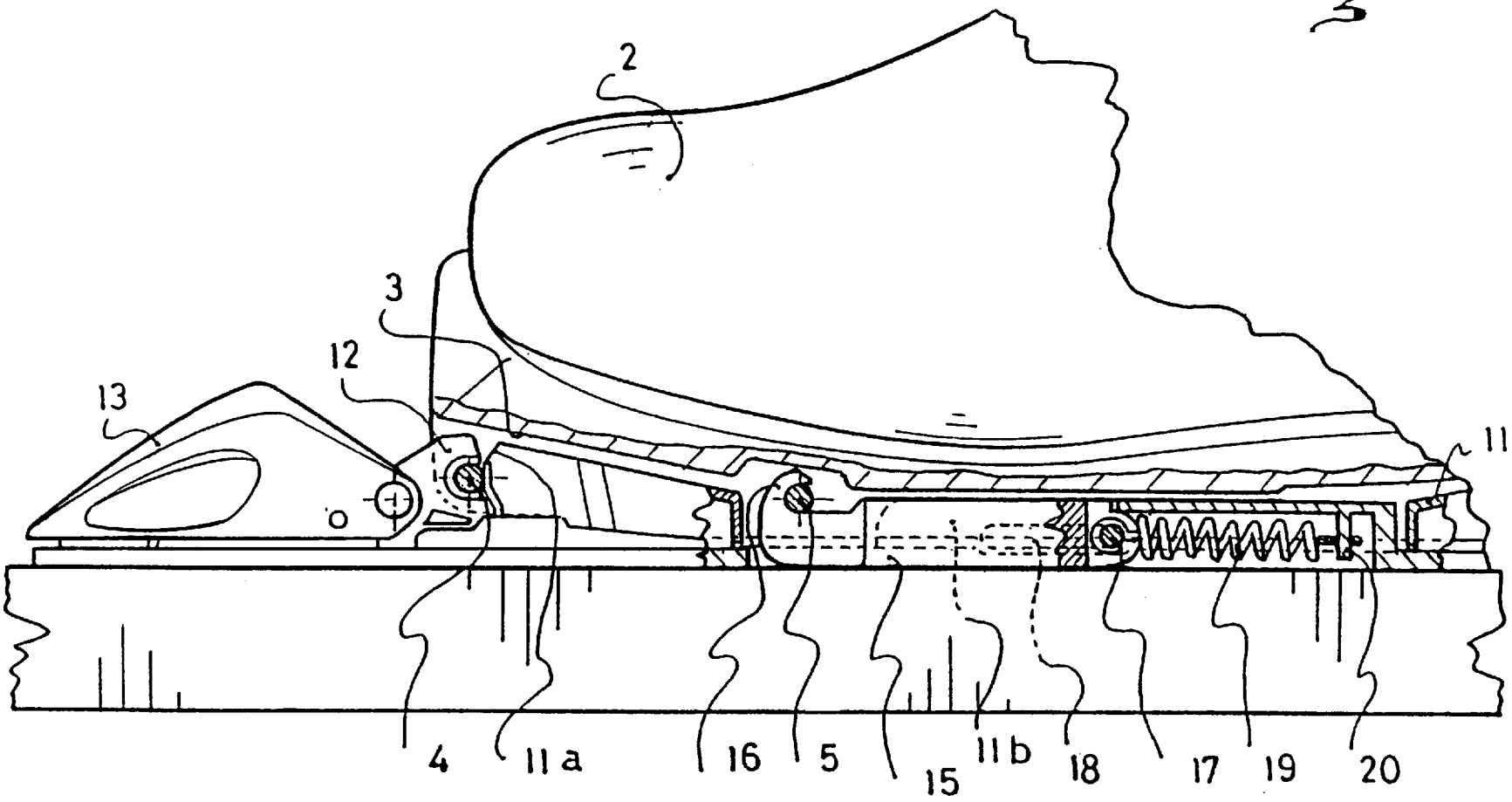
FIG. 3 is a view similar to FIG. 1 in the latched position of the binding apparatus.

The functioning of the assembly according to the invention is as follows. First, the fitting of the binding apparatus is carried out, after its movable jaw 12 is opened by means of the lever 13, by introducing the front axis 4 of the boot inside the housing demarcated by the movable jaw 12, then by lowering the boot in the direction of the gliding member, its rear axis 5 sliding on the ramp 16*a* of the hook 16 until the axis 5 is engaged into the hook 16, as shown in FIG. 3. As is easily understood, such an engagement, will be made possible by a slight forward/rearward displacement of the hook 16, which is made possible by the presence of the spring 19.

Figure 4:
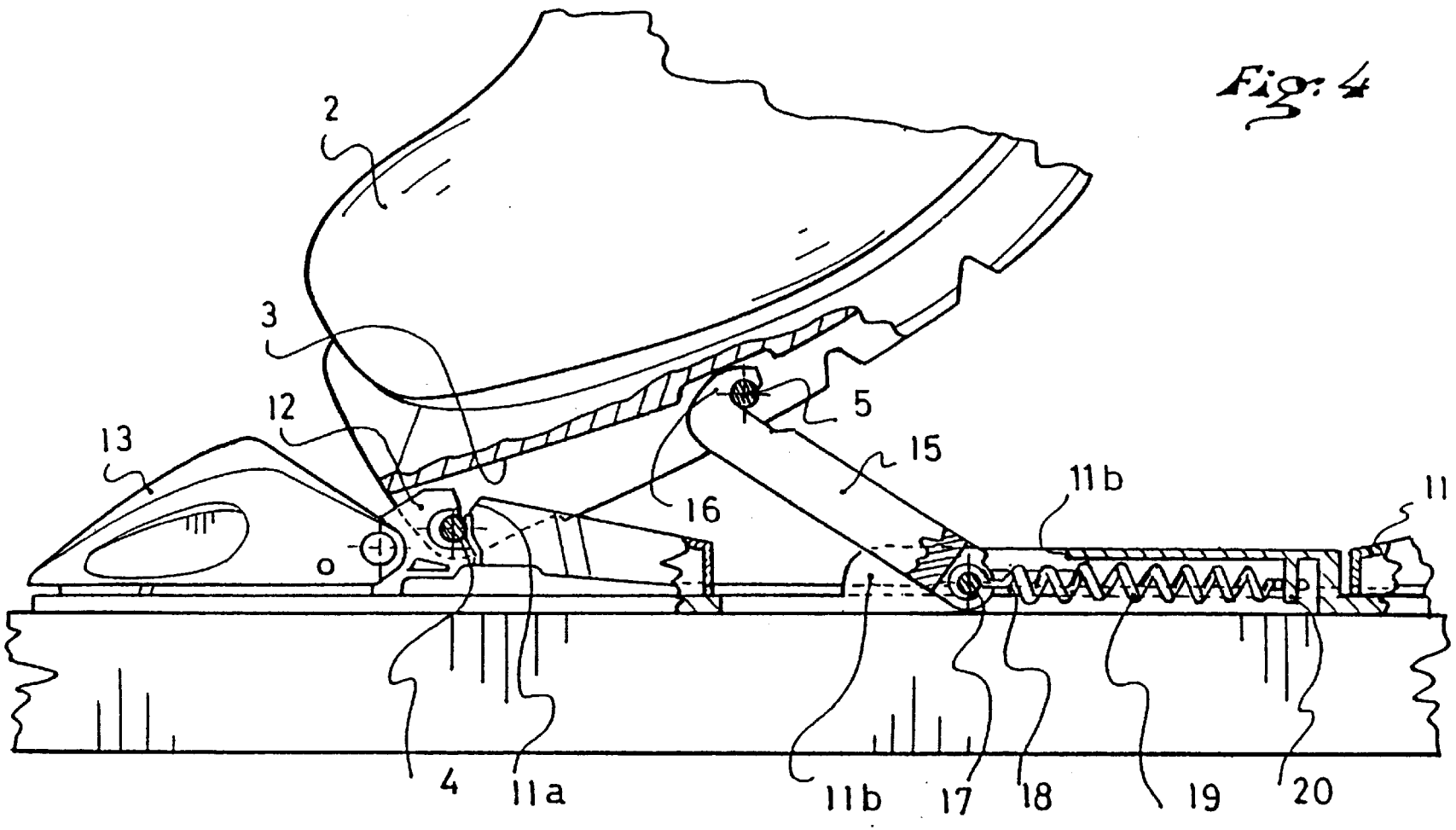
FIG. 4 is a view similar to FIG. 2 during the movement of the boot.

Once the binding 10 is latched, as shown in FIGS. 3 and 4, the boot is connected to the gliding member 1 through its two front and rear attachment members 4, 5, whereby the boot is pivotal about the axis extending through the forward attachment member 4.

On the contrary, such a connection does not limit the movement of the boot, but in fact enables a controlled movement thereof.

Indeed, the sliding/rotating mounting of the connecting rod 15 allows for a displacement thereof in a substantially longitudinal plane, and in this scale, a vertical plane of the boot, enabling the connecting rod to follow the lifting and bending of the boot during the movement of the foot (see FIG. 4) independent of the forward attachment 12, the jaw of which maintains the axis of member 4 fixed with respect to the ski.

Furthermore, the return spring 19 exerts a continuous return force on the connecting rot 15, and therefore on the boot 2.

Thus, even in the positions of extreme movement of the boot, as shown in FIG. 4, the latter will always be returned towards the ski by the hook 16/connecting rod 15/spring 19 assembly, and a constant control of the ski by the boot is obtained in all phases of the foot movement, which had not been the case until now.

Moreover, the integration of the connecting rod and of its return means within the guiding edge of the binding device makes it possible to clear the space at the front of the boot, and allows for an even larger forward rotational movement thereof.

Figure 5:
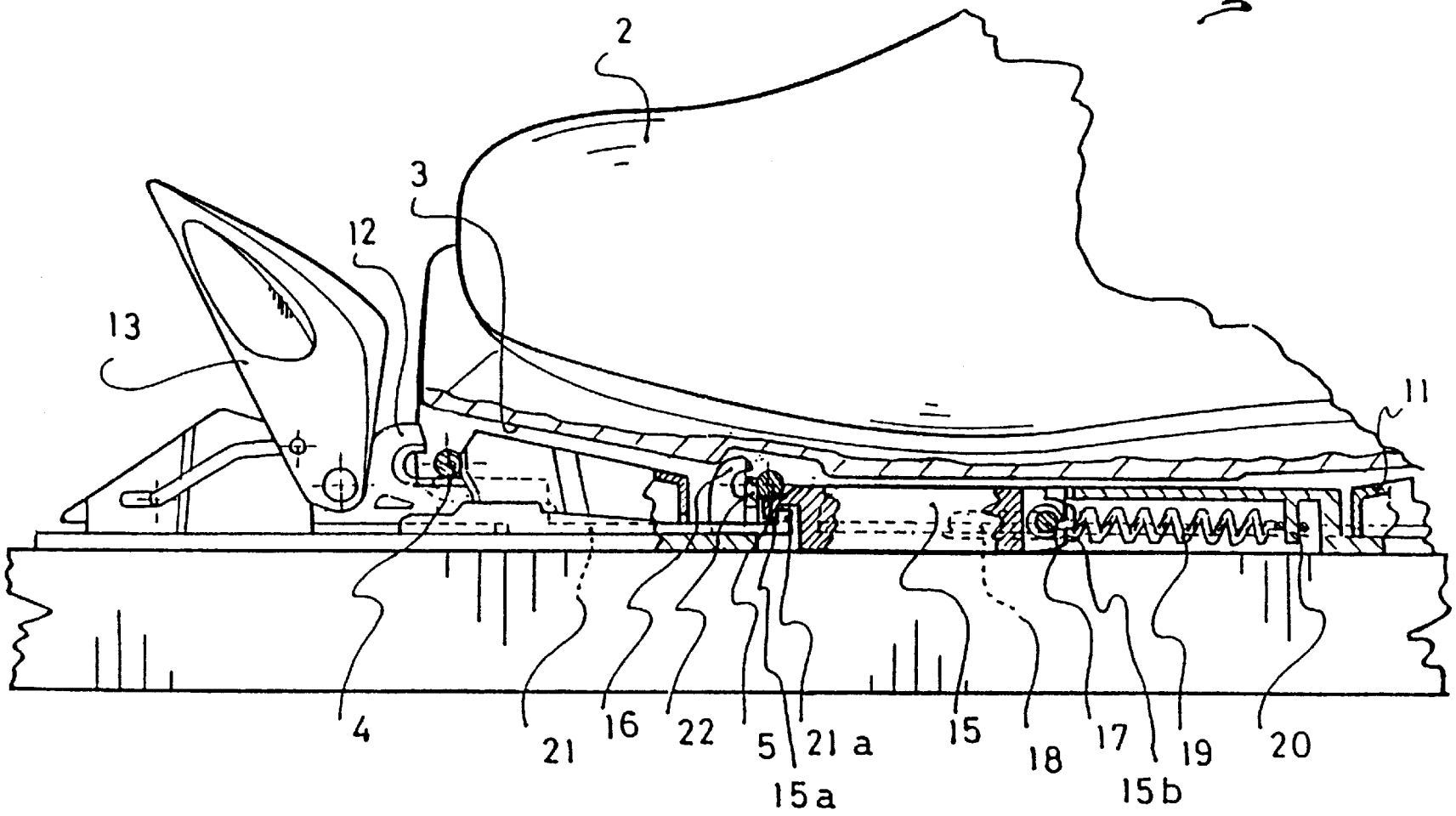
FIG. 5 is a view similar to FIG. 1 according to another embodiment.

The binding apparatus shown in FIG. 5 has an identical functioning, and the same elements will therefore be designated by identical reference numerals.

The only difference with respect to the apparatus of FIGS. 1–4 resides in the provision of an additional linkage member 21 between the two anchoring systems, this linkage member 21 being affixed to the movable jaw 12 and engaged with the connecting rod 115 by a hook-shape element 21*a* engaged with a hook 15*a* associated with the connecting rod.

This linkage member 21 makes it possible to drive the connecting rod 15 forwardly at the same time as the opening of the jaw 12, and therefore to facilitate the disengagement and the exit of the rear axis 5 of the boot from the hook 16.

Of course, the linkage member 21 does not interfere with the pivoting movement of the connecting rod 15, the latter remaining totally free, and it only engages with the hook 15*a* thereof when the latter is in the lower position.

To facilitate the disengagement of the foot, a fixed vertical abutment 22 can be provided to project on the upper surface of the binding, in order to limit the forward movement of the axis 5 of the boot and allow for the disengagement in the vertical direction thereof, until it exits from the hook 16 during the opening of the binding apparatus.

In such an embodiment, the connecting rod 15 has, at its front end, i.e., at the level of the hoot 16, a U-shape or cap-shape extending on both sides of the abutment 22.

Furthermore, the connecting rod 15 has, at its rear ends, a vertical flat surface or cam surface 15*b* adapted to cooperate with the return spring 19 to limit the rotation of the connecting rod, and to favor its return to a resting position inside the recess 11*b* associated with the guiding edge from the lifting position, by a permanent return effect to such position.

Figures 5, 6:
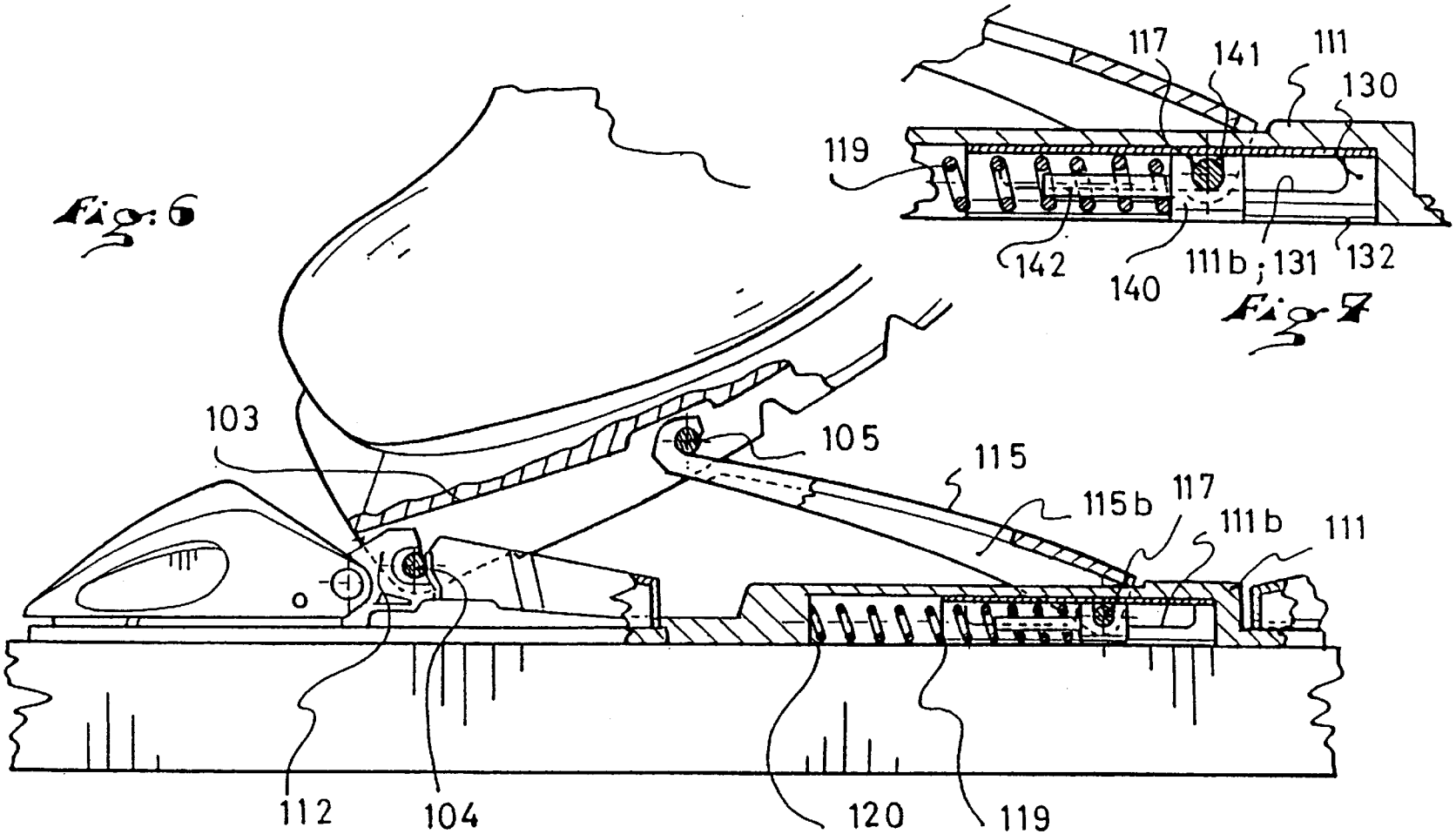
FIG. 6 is a view similar to FIGS. 1 and 5 according to another embodiment.

The binding apparatus shown in FIGS. 6 and 7 has a functioning that is substantially identical to the binding devices of the previous Figures, and similar or identical elements will be designated by the same reference numerals increased by 100.

The essential difference with respect to the apparatus of FIGS. 1–5 resides in the provision of a compression spring 119, instead of a traction spring, for the elastic return of the connecting rod 115.

In this case, the compression spring 119 is mounted inside the guiding rib or edge 11, between the journal 117 of the connecting rod 115, on the one hand, and an abutment surface 120 of the guiding edge located at the front of the journal 117, on the other hand.

As a result, the length of the connecting rod 115 and the center distance of axes 105–117 can therefore be increased with respect to the connecting rod 15, of the previous embodiments.

The result is a much greater possibility for an angle of movement of the boot with respect to the ski, within equal distance from the journal axis 117 in the longitudinal direction.

Furthermore, this increase in the center distance of axes 105–117, and therefore the corresponding modification of the lever arm between the two axes 105–117 enables a bias, and consequently an elastic response from the spring, which is closer to that obtained with a natural or synthetic rubber material, and therefore more comfortable.

As shown more particularly in FIG. 7, the connecting rod, unlike the connecting rod 15 of the previous embodiments, is journalled on the guiding edge 111 outside of the latter, by means of its journal axis 117 slidably mounted in two lateral slots 111*b* of the edge.

Moreover, the journal axis 117 is housed in a semicircular transverse groove 141 of a bearing 140 which also serves as a support surface for the spring and comprises an axial projection 142 for guiding the spring 119 during its compression/extension movements.

The inside of the recess 111*b* of the guiding edge 111 which receives the spring 119 is encased in a metallic sheath 130. This substantially cylindrical sheath 130 comprises two lateral grooves 131 opposite the grooves 111*b* of the guiding edge for the slidable mounting of the journal axis 117 and extends over the largest portion of the length of the recess 111*b*. The sheath 130 is merely slit longitudinally at its lower end 132 so as to avoid the direct contact of the spring 119 with the upper surface of the ski.

The role of this sheath 130 is multiple:

ensuring a resumption of forces and a protection of the inside of the edge against the spring and the forces transmitted by the axis 117, forming a cage narrowly surrounding the spring which guides it and limits any deformation and buckling thereof during its displacement, and makes it possible to guarantee the force stroke desired for the spring, ensuring a protection against the upper surface of the ski by avoiding the deformations of the spring during its stroke, maintaining the spring in position before the mounting of the binding on the ski (premounting effect).

It is also noted that the journal of the connecting rod 115 laterally on the guiding edge makes it possible to avoid the presence of an opening on the upper surface of the guiding edge, and consequently to guarantee a better imperviousness of the assembly, the edges and the openings 111*b* of the edge being covered by lateral walls 115*b* of the connecting rod.

Finally, in all the embodiments shown, the spring can be calibrated differently (by interposing calibration washers, quarter turn or screw calibration system, etc.) so as to modify the force curve of the spring and personalize it depending on the skier.

Of course, the present invention is not limited to an application to cross country ski, but can be used for any connection of a boot to a gliding member, including roller skates, while leaving the rear portion of the boot free to lift.

What is claimed:

1. A binding apparatus adapted to be affixed to an upper surface of a gliding element for binding a front portion of a boot to the gliding element, the boot having first and second longitudinally spaced attachment members at the front portion of the boot, a rear portion of the boot being free to be raised with respect to the gliding element, said binding apparatus comprising:

a forwardmost attachment adapted to releasably connect the first boot attachment member to the gliding element to facilitate pivoting of the boot about an axis fixed with respect to the gliding element;

a rearward attachment, rearward of said forwardmost attachment, adapted to releasably attach the second boot attachment member to the gliding element, said rearward attachment comprising:

an anchoring part structurally configured and positioned to engage the second attachment member of the boot;

an elastic return device continuously applying an elastic return force to said anchoring part to bias the boot in a direction toward the gliding element.

2. A binding apparatus according to claim 1, wherein:

said rearward attachment includes a connecting member, said connecting member including said anchoring part;

said connecting member is mounted for movement with the boot independent of any movement of said forwardmost attachment.

3. A binding apparatus according to claim 1, wherein:

said rearward attachment is positioned for attachment to the second boot attachment member in the metatarsophalangeal journal zone of the foot.

4. A binding apparatus according to claim 1, wherein:

said rearward attachment comprises a longitudinally extending connecting member, said connecting member having a first end comprising said anchoring part, said elastic return device being connected to a second end of said connecting member.

5. A binding apparatus according to claim 4, further comprising:

a longitudinally extending rib adapted to become seated in a longitudinally extending groove of the boot;

wherein said second end of said connecting member is connected to said rib by means of a transversely extending journal; and wherein said rib further includes means for mounting said transversely extending journal for longitudinal sliding with respect to said rib, said elastic return device being connected to apply said elastic return force in opposition to said longitudinal sliding of said journal.

6. A binding apparatus according to claim 1, further comprising:

a linkage element between said forwardmost attachment and said rearward attachment, said linkage element comprising means for simultaneously moving said forwardmost attachment and said rearward attachment to a release position.

7. A binding apparatus according to claim 5, further comprising:

a fixed abutment provided at said rearward attachment, said fixed abutment comprising means for disengaging the second boot attachment member during movement of said rearward attachment to a release position.

8. A binding apparatus according to claim 4, wherein:

said first end of said longitudinally extending connecting member is a front end and said second end of said longitudinally extending connecting member is a rear end, wherein said front end of said longitudinally extending connecting member is adapted to move vertically as the rear portion of the boot is raised with respect to the gliding element.

9. A binding apparatus according to claim 4, further comprising:

a longitudinally extending rib adapted to become seated in a longitudinally extending groove of the boot, said rib including a lowermost surface adapted to be affixed to an upper surface of the gliding element;

said connecting member and said elastic return device being positioned, during use of the binding, above said lowermost surface of said rib.

10. An assembly of a boot and a binding apparatus for connecting a front portion of the boot to an upper surface of a gliding element, said assembly comprising:

a boot having a front portion, said front portion of the boot including first and second longitudinally spaced attachment members;

a binding apparatus comprising:

a forwardmost attachment adapted to releasably connect the first boot attachment member to the gliding element to facilitate pivoting of the boot about an axis fixed with respect to the gliding element, a rear portion of the boot being free to be raised with respect to the gliding element;

a rearward attachment, rearward of said forwardmost attachment, adapted to releasably attach the second boot attachment member to the gliding element, said rearward attachment comprising an anchoring member adapted to engage the second attachment member of the boot; and an elastic return device, affixed to said binding apparatus, continuously applying an elastic return force to said anchoring member of said binding apparatus to bias said rear portion of the boot in a direction toward the gliding element.

11. An assembly according to claim 10, wherein:

said axis extends through said first boot attachment member.

12. An assembly according to claim 10, wherein:

said rearward attachment is positioned for attachment to said second boot attachment member in the metatarsophalangeal journal zone of the foot.

13. An assembly according to claim 10, wherein:

said rearward attachment comprises a longitudinally extending connecting member, said connecting member having a first end comprising said anchoring member, said elastic return device being connected to a second end of said connecting member.

14. An assembly according to claim 13, further comprising:

a longitudinally extending rib adapted to become seated in a longitudinally extending groove of said boot;

wherein said second end of said connecting member is connected to said by means of a transversely extending journal; and wherein said rib further includes means for mounting said transversely extending journal for longitudinal sliding with respect to said rib, said elastic return device being connected to apply said elastic return force in opposition to said longitudinal sliding of said journal.

15. An assembly according to claim 14, further comprising:

a linkage element between said forwardmost attachment and said rearward attachment, said linkage element comprising means for simultaneously moving said forwardmost attachment and said rearward attachment to a release position.

16. An assembly according to claim 14, further comprising:

a fixed abutment provided at said rearward attachment, said fixed abutment comprising means for disengaging the second boot attachment member during movement of said rearward attachment to a release position.

17. An assembly according to claim 13, wherein:

said first end of said longitudinally extending connecting member is a front end and said second end of said longitudinally extending connecting member is a rear end, wherein said front end of said longitudinally extending connecting member is adapted to move vertically as the rear portion of said boot is raised with respect to the gliding element.

18. A binding apparatus according to claim 13, further comprising:

a longitudinally extending rib adapted to become seated in a longitudinally extending groove of the boot, said rib including a lowermost surface adapted to be affixed to an upper surface of the gliding element;

said connecting member and said elastic return device being positioned, during use of the binding, above said lowermost surface of said rib.

19. An assembly of a boot and a binding apparatus for connecting a front portion of the boot to an upper surface of a gliding element, said assembly comprising:

a boot having a front portion, said front portion of the boot including first and second longitudinally spaced attachment members;

means for binding the front portion of the boot to the gliding element, at the first attachment member of the boot, to allow pivotal movement of the boot about the first attachment member of the boot, and for allowing a rear portion of the boot being free to be raised with respect to the gliding element; and means for applying a continuous elastic return force at the second attachment member of the boot, rearward of the first attachment member.

* * * * *